US008152143B2

(12) United States Patent
Chuah et al.

(10) Patent No.: US 8,152,143 B2
(45) Date of Patent: Apr. 10, 2012

(54) STRUCTURE OF COOLING TOWER

(75) Inventors: Yew-Khoy Chuah, Taipei (TW); Chia-Wei Liu, Taipei (TW); Nien-Hung Yao, Taipei (TW); Min-Hsiang Hung, Taipei (TW)

(73) Assignee: National Taipei University Technology, Taipei (TW)

( * ) Notice: Subject to any disclaimer, the term of this patent is extended or adjusted under 35 U.S.C. 154(b) by 782 days.

(21) Appl. No.: 12/146,198

(22) Filed: Jun. 25, 2008

(65) Prior Publication Data

US 2009/0321968 A1 Dec. 31, 2009

(51) Int. Cl.
*B01F 3/04* (2006.01)

(52) U.S. Cl. ..... 261/109; 261/159; 261/DIG. 11

(58) Field of Classification Search ..... 261/109, 261/159, DIG. 11
See application file for complete search history.

(56) References Cited

U.S. PATENT DOCUMENTS 3,707,277 A * 12/1972 Phelps ..... 261/23.1
3,791,634 A * 2/1974 Phelps ..... 261/111
3,846,519 A * 11/1974 Spangemacher ..... 261/151
3,917,764 A * 11/1975 Phelps ..... 261/111
3,923,935 A * 12/1975 Cates ..... 261/159
3,994,999 A * 11/1976 Phelps ..... 261/159
4,515,735 A * 5/1985 Phelps ..... 261/111
4,834,955 A * 5/1989 Mouche et al. ..... 423/243.05
5,283,012 A * 2/1994 Bugler et al. ..... 261/23.1
5,427,718 A * 6/1995 Phelps ..... 261/23.1
5,449,036 A * 9/1995 Genge et al. ..... 165/104.19
5,569,415 A * 10/1996 Phelps ..... 261/23.1
5,770,117 A * 6/1998 Phelps ..... 261/23.1
6,070,860 A * 6/2000 Kinney et al. ..... 261/30
6,880,622 B1 * 4/2005 Gu ..... 165/96

* cited by examiner

*Primary Examiner* — Robert J Hill, Jr.
*Assistant Examiner* — Christopher P Jones
(74) *Attorney, Agent, or Firm* — Schmeiser Olsen & Watts LLP

(57) ABSTRACT

An improved structure of cooling tower includes a fan housing with a fan disposed therein, induction openings distributed on the fan housing and located below the fan, and a diffuser stack disposed at one end surface of the fan housing. In operation, cold air is drawn into the cooling tower by the fan through inlet openings of the cooling tower so as to exchange heat with the condensing water within a water chiller. When warm and wet air is drawn out of the cooling tower and the warm and wet air outside the cooling tower is induced in through the induction openings and then is drawn out, circulation reflux of warm and wet air, which tends to occur in conventional cooling towers, can be avoided and therefore increase the efficiency of the water chiller.

7 Claims, 3 Drawing Sheets

STRUCTURE OF COOLING TOWER

BACKGROUND OF THE INVENTION

1. Field of the Invention

The present invention relates to an improved structure of cooling tower and, in particular, to an improved structure of cooling tower that can avoid short circulation of warm and wet air refluxing into the cooling tower, by means of induction openings and a diffuser stack, so that the water chiller increases its efficiency.

2. Description of the Prior Art

With developments in industry and commerce, people hold a heightened standard of living. Nowadays, air conditioners have been indispensable for residential or commercial buildings. Although the application of air conditioners brings healthy and comfortable surroundings for living, it often results in the crisis of power shortage in summer. Moreover, due to the difficulty of establishing power plants and the global decrease in energy resources, a critical issue is how to save and utilize energy efficiently.

Generally, an air conditioning system operates by using a water chiller. Referring to FIG. 1, a water chiller performs heat exchange with a cooling tower 1, which can affect the efficiency of the water chiller. In high population density environments, the cooling tower 1 is usually mounted on the roof of a building. However, the available roof space is rather limited for accommodating multiple cooling towers connected in parallel. Therefore, the warm and wet air that has been drawn out of the cooling towers 1 tends to reflux circulatively. In other words, warm and wet air at the outlet of the cooling tower 1 may be circulatively drawn in through inlet opening 14 disposed at the lower portion of the cooling tower 1 and then causes short circulation. This short circulation can impose heavier loads on the cooling tower 1; thus, the dissipation capability of the cooling tower 1 can be reduced significantly, which causes the temperature of the outlet condensing water to be too high. As a result, the efficiency of the water chiller will be decreased and the power consumption will be increased.

Since the conventional way has such drawbacks as described above, it is hardly a good solution. An improvement is required urgently.

In view of the above difficulties associated with the conventional way, the present inventor, through a long-term study and practice, has developed an improvement and innovation that provides the present improved structure of fan housing for a cooling tower.

SUMMARY OF THE INVENTION

The primary aspect of this invention is to provide an improved structure of cooling tower that can avoid the short circulation of the warm and wet air refluxing into the cooling tower, by means of induction openings and a diffuser stack, so as to increase the efficiency of the water chiller.

Another aspect of this invention is to provide an improved structure of cooling tower that can increase the heat removal efficiency of the cooling tower and the energy efficiency of the associated water chiller, so as to decrease the power consumption.

In addition, a further aspect of this invention is to provide an improved structure of cooling tower that applies a diffuser stack disposed at one end surface of a fan housing to effectively increase the flow rate of the outlet air from the fan housing as well as to facilitate the induction of air through induction openings.

An improved structure of cooling tower that can fulfill the above aspects that mainly comprises a cooling tower, a fan housing, more than one induction openings, and a diffuser stack. The fan housing contains a fan disposed therein. The induction openings are distributed on the fan housing and located below the fan, for inducing the warm and wet air outside the cooling tower into the cooling tower. The diffuser stack is disposed at one end surface of the fan housing to effectively increase the flow rate of the outlet air from the fan housing as well as to facilitate the induction of air through the induction openings. In operation, cold air is drawn into the cooling tower by the fan through inlet openings of the cooling tower so as to exchange heat with the condensing water within a water chiller, when the warm and wet air is drawn out of the cooling tower, the warm and wet air outside the cooling tower is induced in through the induction openings and then be drawn out so that circulation reflux of warm and wet air, which tends to occur in conventional cooling towers, can be avoided and therefore the efficiency of the water chiller is increased.

These features and advantages of the present invention will be fully understood and appreciated from the following detailed description of the accompanying drawings.

DESCRIPTION OF THE PREFERRED EMBODIMENT

Figure 1:
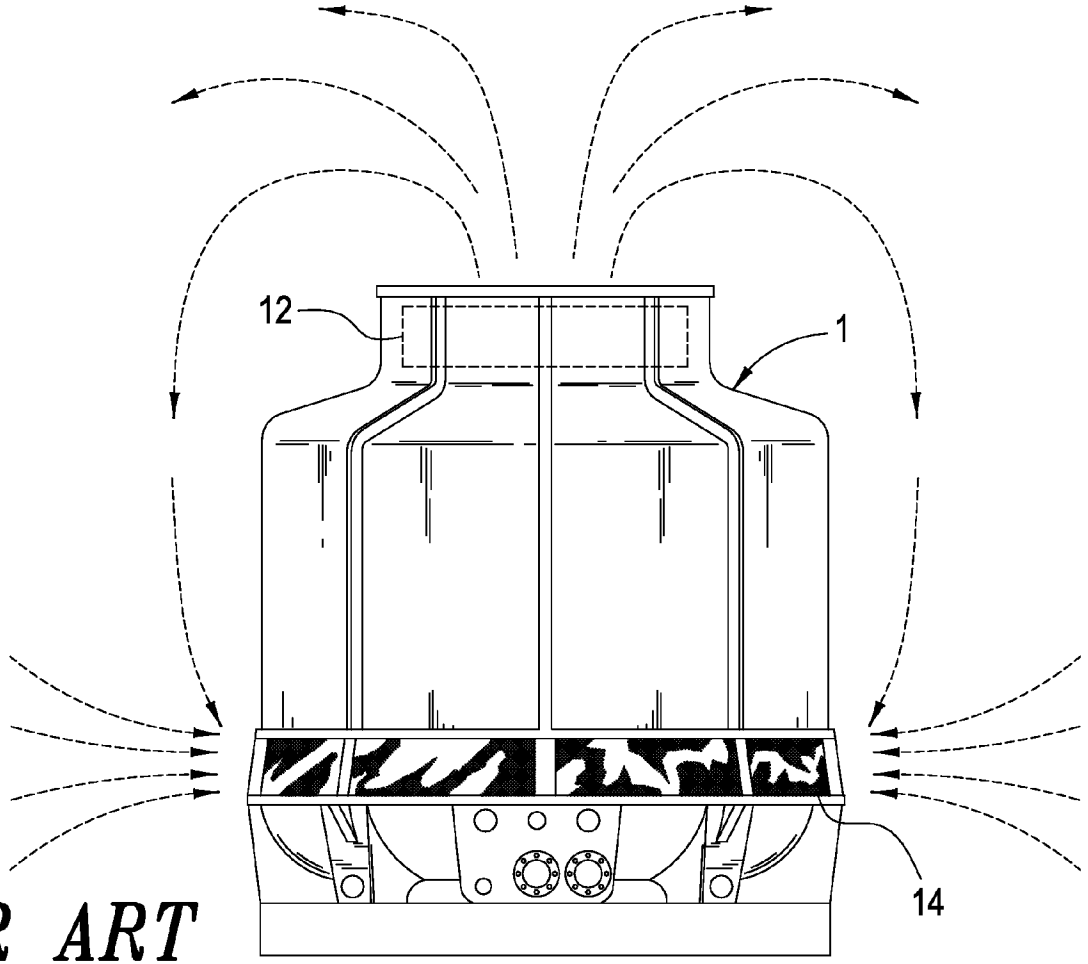
PRIOR ART FIG. 1
FIG. 1 is a schematic diagram of implementing a conventional cooling tower.
Figure 2:
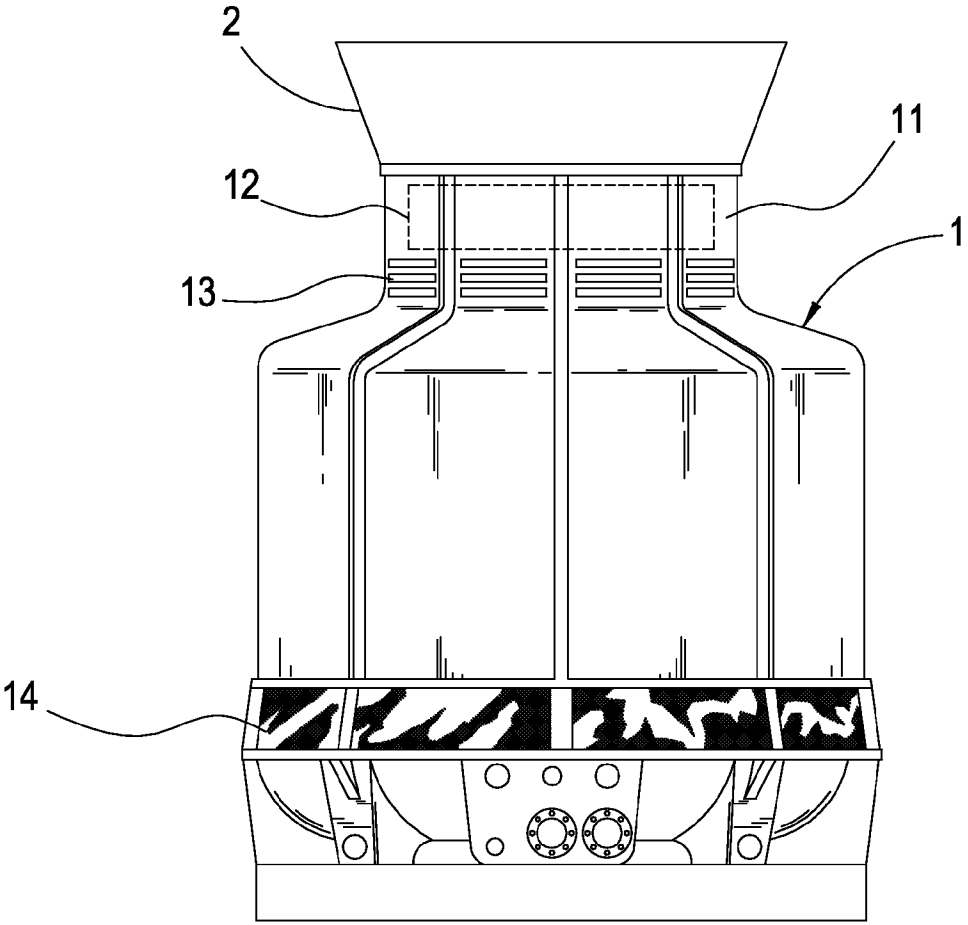
FIG. 2 is a side view of the improved structure of fan housing for cooling tower according to the present invention.

Referring to FIG. 2, which shows the improved structure of cooling tower according to the present invention, the structure of a cooling tower mainly comprises a cooling tower 1. The cooling tower 1 comprises a fan housing 11 formed at the upper portion thereof. The fan housing 11 contains a fan 12 disposed therein. The cooling tower 1 comprises more than one induction openings 13 distributed on the fan housing 11 and located below the fan 12. The cooling tower 1 also comprises more than one inlet openings 14 disposed at the lower portion thereof, The cooling tower 1 comprises a diffuser stack 2 disposed at the end surface of the fan housing 11. The diffuser stack 2 is a chimney with a wide upper portion and a narrow lower portion.

Figure 3:
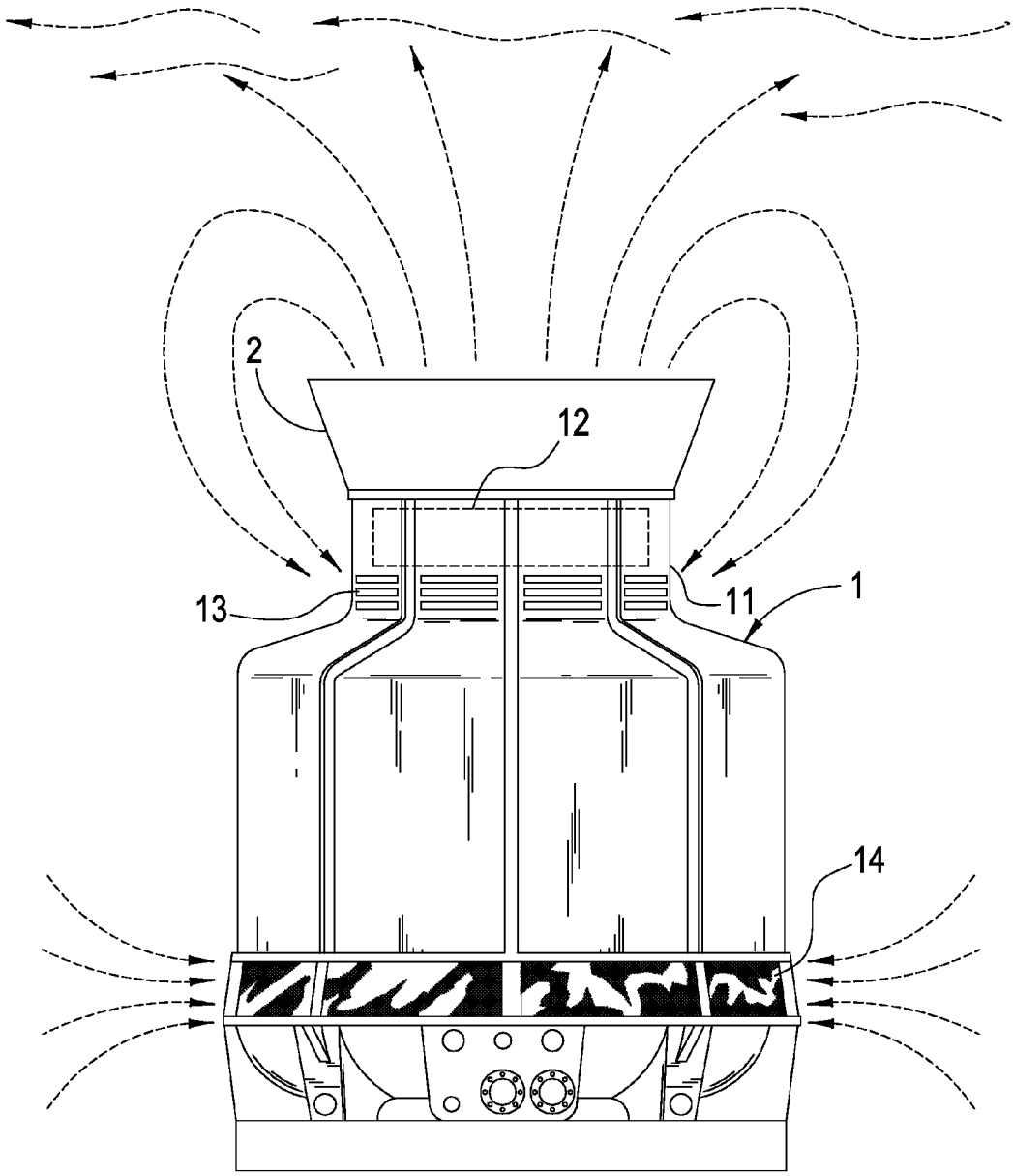
FIG. 3 is a schematic diagram of implementing the improved structure of fan housing for cooling tower according to the present invention.

The improved structure of cooling tower according to the present invention is composed of the elements described above. By means of the induction openings and the diffuser stack in cooperation, the capability of the fan to draw air is increased effectively so that the outlet warm and wet air is rectified and, thus, expelled quickly to a higher level of the atmosphere, as shown in FIG. 3. Furthermore, as the induction openings produce a negative pressure, the air outside the cooling tower can be induced. Thus, part of the subsiding warm and wet air outside the cooling tower can be induced into the cooling tower and then be drawn out by the fan. Thus, the short circulation can be avoided and the heat removal efficiency of the cooling tower and the energy efficiency of the associated water chiller can be increased.

The improved structure of fan housing for cooling tower provided by the present invention, as compared with conventional technologies, has the following advantages.

1. It can avoid the short circulation of the warm and wet air refluxing into the cooling tower by means of induction openings and a diffuser stack in cooperation, so as to increase the efficiency of the water chiller.

2. It can increase the heat removal efficiency of the cooling tower and the energy efficiency of the associated water chiller, so as to decrease the power consumption.

3. It can effectively increase the flow rate of the outlet air from the fan housing as well as facilitate the induction for air through the induction openings by means of a diffuser stack disposed at one end surface of the fan housing.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An improved structure of cooling tower, comprising:

a cooling tower, the cooling tower being configured to exchange heat with condensing water passing therethrough, the cooling tower having a fan housing formed at the upper portion thereof, the fan housing containing a fan disposed therein, and the fan housing having more than one induction opening distributed thereon and located below the fan, and the cooling tower having more than one inlet opening disposed at the lower portion thereof, wherein ambient air can be drawn into the cooling tower by the fan, through the more than one inlet opening, the ambient air exchanging heat with the condensing water resulting in the ambient air becoming warm and wet air that can be drawn out of the cooling tower by the fan through the fan housing to the outside atmosphere, and portions of the warm and wet air thus drawn out of the cooling tower can be induced in through the induction openings above the condensing water and drawn out of the cooling tower through the fan housing by the fan without passing by the condensing water to avoid circulation reflux of the warm and wet air over the condensing water.

2. The improved structure of cooling tower of claim 1, further comprising:

a diffuser stack which is disposed at one end surface of the fan housing.

3. The improved structure of cooling tower of claim 2, wherein the diffuser stack is a chimney with a wide upper portion and a narrow lower portion.

4. The improved structure of cooling tower of claim 1, wherein the cooling tower is configured to restrict the warm and wet air drawn out of the cooling tower and thereafter induced into the cooling tower via the more than one induction opening from re-entering the cooling tower via the more than one inlet opening.

5. An improved structure of a cooling tower, comprising:

a cooling tower, the cooling tower being structured to exchange heat therein by passing ambient air over condensing water passing therethrough;

a fan housing formed at an upper portion of the cooling tower;

a fan, the fan being disposed in the fan housing;

induction openings, the induction openings being distributed on the fan housing and positioned below the fan;

inlet openings, the inlet openings being disposed at a lower portion of the cooling tower, wherein the cooling tower is configured to draw ambient air into the cooling tower by the fan through the inlet openings, the ambient air exchanging heat with the condensing water within the cooling tower, the condensing water passing through the cooling tower entirely below the induction openings, the ambient air becoming warm and wet air after the heat exchange, the cooling tower being configured to draw the warm and wet air out of the cooling tower by the fan through the fan housing and to discharge the warm and wet air above the cooling tower to the outside atmosphere, and wherein the cooling tower is configured to induce by the fan a portion of the warm and wet air discharged above the cooling tower in through the induction openings in the fan housing, wherein the warm and wet air drawn out of the cooling tower by the fan through the fan housing prohibits the portion of the warm and wet air induced through the induction openings from passing below the induction openings to avoid circulation reflux of the warm and wet air over the condensing water.

6. The improved structure of cooling tower of claim 5, further comprising:

a diffuser stack which is disposed at one end surface of the fan housing.

7. The improved structure of cooling tower of claim 6, wherein the diffuser stack is a chimney with a wide upper portion and a narrow lower portion.

* * * * *